US008079886B2

(12) United States Patent
Fukuoka

(10) Patent No.: US 8,079,886 B2
(45) Date of Patent: Dec. 20, 2011

(54) COOLING SYSTEM FOR OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 429 days.

(21) Appl. No.: 12/340,959

(22) Filed: Dec. 22, 2008

(65) Prior Publication Data

US 2009/0163092 A1 Jun. 25, 2009

(30) Foreign Application Priority Data

Dec. 25, 2007 (JP) ..... 2007-332790

(51) Int. Cl.
*F01P 3/20* (2006.01)

(52) U.S. Cl. ..... 440/88 D; 440/88 C

(58) Field of Classification Search ..... 440/75, 440/88 D, 88 P, 88 C
See application file for complete search history.

(56) References Cited

U.S. PATENT DOCUMENTS

| | | | | |
|---|---|---|---|---|
| 4,747,795 | A * | 5/1988 | Kawamura et al. | 440/75 |
| 7,892,056 | B2 * | 2/2011 | Okabe et al. | 440/88 D |
| 2008/0070739 | A1 | 3/2008 | Nakamura et al. | |
| 2008/0233815 | A1 | 9/2008 | Nakamura et al. | |

FOREIGN PATENT DOCUMENTS

| | | | |
|---|---|---|---|
| JP | 3509171 | B2 | 3/2004 |
| WO | 2007/007707 | A1 | 1/2007 |

* cited by examiner

*Primary Examiner* — Edwin Swinehart
(74) *Attorney, Agent, or Firm* — Keating & Bennett, LLP

(57) ABSTRACT

A cooling system includes a coolant distributing device arranged to distribute coolant discharged from a water pump to both an engine and a transmission device. The coolant distributing device includes a coolant relay section, an inlet conduit member, an outlet conduit member, and a transmission cooling conduit member, and supplies a portion of the coolant discharged from the water pump to a highest portion of a water jacket of the transmission device, and discharges the water from a lowest portion of the water jacket. The cooling system effectively cools the transmission device with a simple construction facilitating assembly and maintenance.

5 Claims, 7 Drawing Sheets

COOLING SYSTEM FOR OUTBOARD MOTOR

BACKGROUND OF THE INVENTION

1. Field of the Invention

The present invention relates to a cooling system for an outboard motor arranged to supply outside water as a coolant pumped by a water pump to an engine and a transmission device.

2. Description of the Related Art

In conventional cooling systems for outboard motors, as disclosed in JP-B-3509171, a water pump is disposed in a vicinity of an upper surface of a lower case, and the water pump is driven by a drive shaft for transmitting the engine output to a propeller. A water intake is provided in a position below a waterline of the lower case. Outside water is introduced from the water intake, and then drawn into and discharged from the water pump when the water pump is driven. Thereafter, the water passes through a metallic coolant conduit member to rise into an upper case where it is supplied to an engine.

Recently, there have been developed outboard motors in which a transmission is located in a middle portion of a drive shaft to perform automatic speed changes and rotational direction switching of the drive shaft rotation, for example, as disclosed in WO 2007-007707.

A large number of devices such as a torque converter and a planetary gear mechanism are compactly installed in the transmission device. Therefore, the operating temperature tends to increase, and the temperature of lubricating oil stored in the transmission device increases due to the operating heat. This may result in degradation of the lubricating oil and further deterioration in the durability of the transmission device.

SUMMARY OF THE INVENTION

In order to overcome the problems described above, preferred embodiments of the present invention provide a cooling system for an outboard motor that achieves effective cooling of a transmission device with a simple construction facilitating assembly and maintenance of the outboard motor.

A preferred embodiment of the present invention provides a cooling system for an outboard motor having an engine installed in an upper portion of a casing, a transmission device installed inside the casing, and a water pump arranged to pump coolant for cooling the engine, the cooling system including a coolant distributing device arranged to distribute coolant discharged from the water pump to both the engine and the transmission device.

Another preferred embodiment of the present invention provides a cooling system for an outboard motor in which the coolant distributing device is arranged to supply a portion of the coolant discharged from the water pump to a highest portion of a water jacket of the transmission device and discharge the coolant from a lowest portion of the water jacket.

Another preferred embodiment of the present invention provides a cooling system in which the water pump is arranged such that at least a coolant inlet and a coolant outlet thereof face an outside of the casing, and the coolant distributing device includes a coolant relay section provided outside the casing and in communication with an engine coolant supply path in the casing, an inlet conduit member located outside the casing and having an upstream end connected to a water intake provided below the casing and a downstream end connected to the coolant inlet, an outlet conduit member located outside the casing to connect the coolant outlet and the coolant relay section together, and a transmission cooling conduit member having a first end connected to the coolant relay section and a second end connected to a highest portion of a cooling portion of the transmission device.

Another preferred embodiment of the present invention provides a cooling system in which bore diameters of the inlet conduit member and the outlet conduit member are different from a bore diameter of the coolant relay section.

Another preferred embodiment of the present invention provides a cooling system in which at least one of the inlet conduit member, the outlet conduit member, and the coolant relay section includes a flexible hose member.

In accordance with a first preferred embodiment of the present invention, coolant can be supplied to the engine and the transmission device by a single water pump. Therefore, it is not required to provide another cooling system especially for cooling the transmission device, and the transmission device can be effectively cooled with a simple construction.

In accordance with a second preferred embodiment of the present invention, the highest portion to the lowest portion of the transmission device can be effectively cooled with the flow of coolant due to natural convection.

In accordance with a third preferred embodiment of the present invention, at least the coolant inlet and the coolant outlet of the water pump, an end section of a water intake path extending from the water intake, the coolant relay section, the inlet conduit member, the outlet conduit member, the transmission cooling conduit member, and so forth are preferably located outside the casing. This facilitates connection between these members. Accordingly, the transmission device can be effectively cooled with a construction facilitating assembly and maintenance.

In accordance with a fourth preferred embodiment of the present invention, the bore diameter of the coolant relay section is preferably set to a value corresponding to the inlet conduit member and the outlet conduit member, thereby allowing the most effective cooling of the transmission device.

In accordance with a fifth preferred embodiment of the present invention, the arrangement of each of the conduit members can be improved because they are preferably made of flexible hose members, and the connections of the conduit members are facilitated. This provides an improvement in the assembly of the outboard motor.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter with reference to FIGS. 1 through 7.

Figure 1:
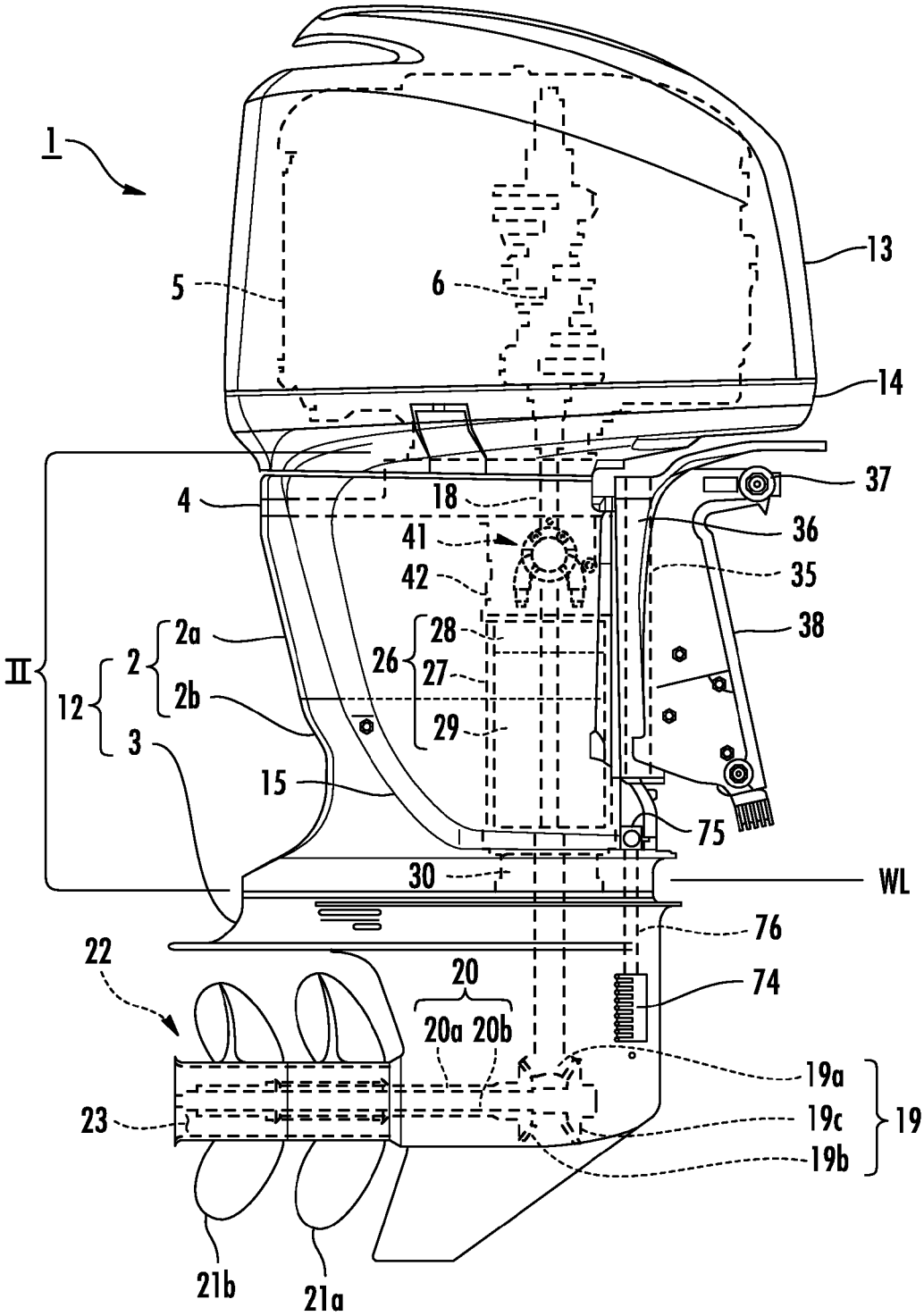
FIG. 1 is a right side view of an outboard motor in accordance with a preferred embodiment of the present invention.
Figure 2:
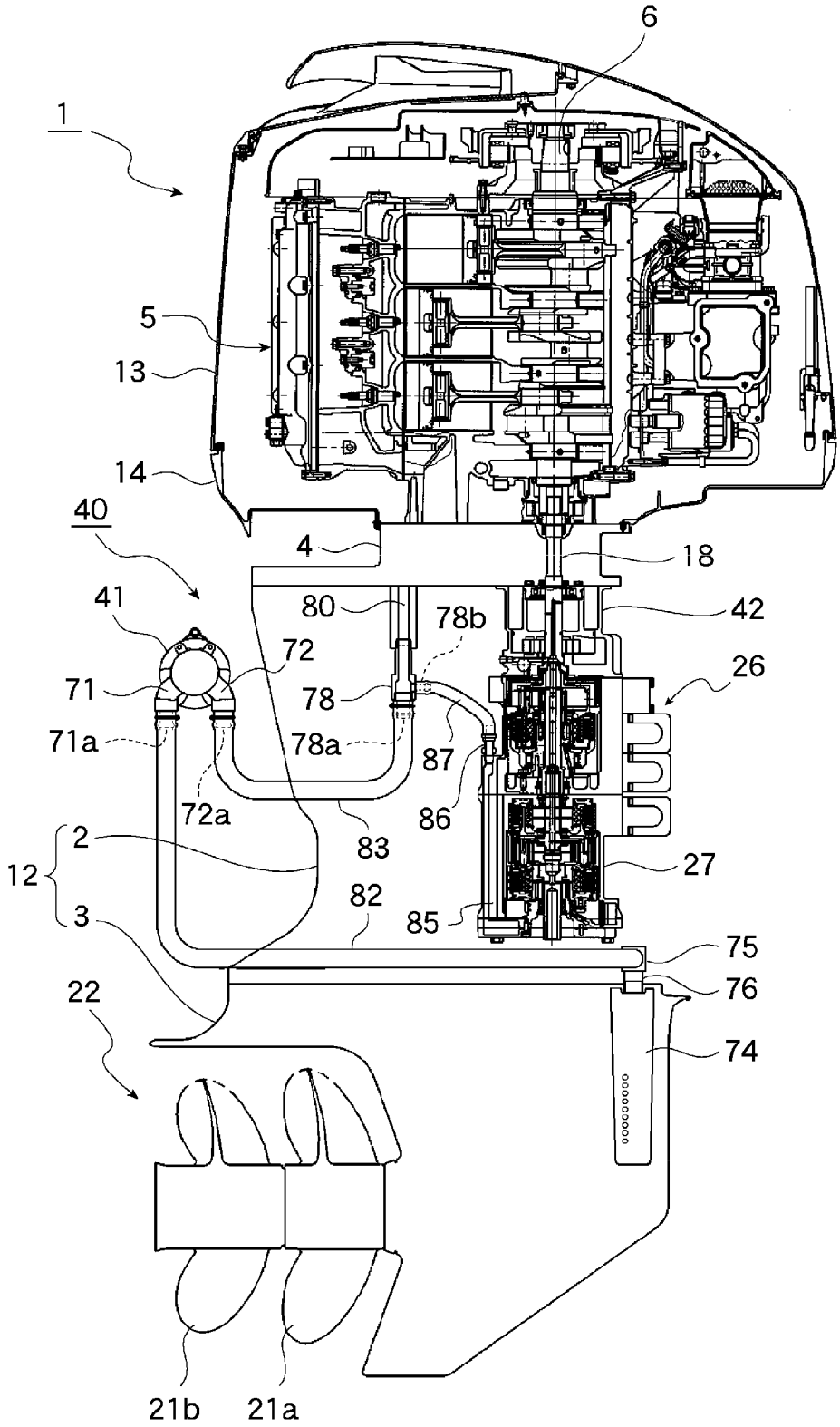
FIG. 2 is a more detailed vertical cross-sectional view of FIG. 1 in accordance with a preferred embodiment of the present invention.
Figure 3:
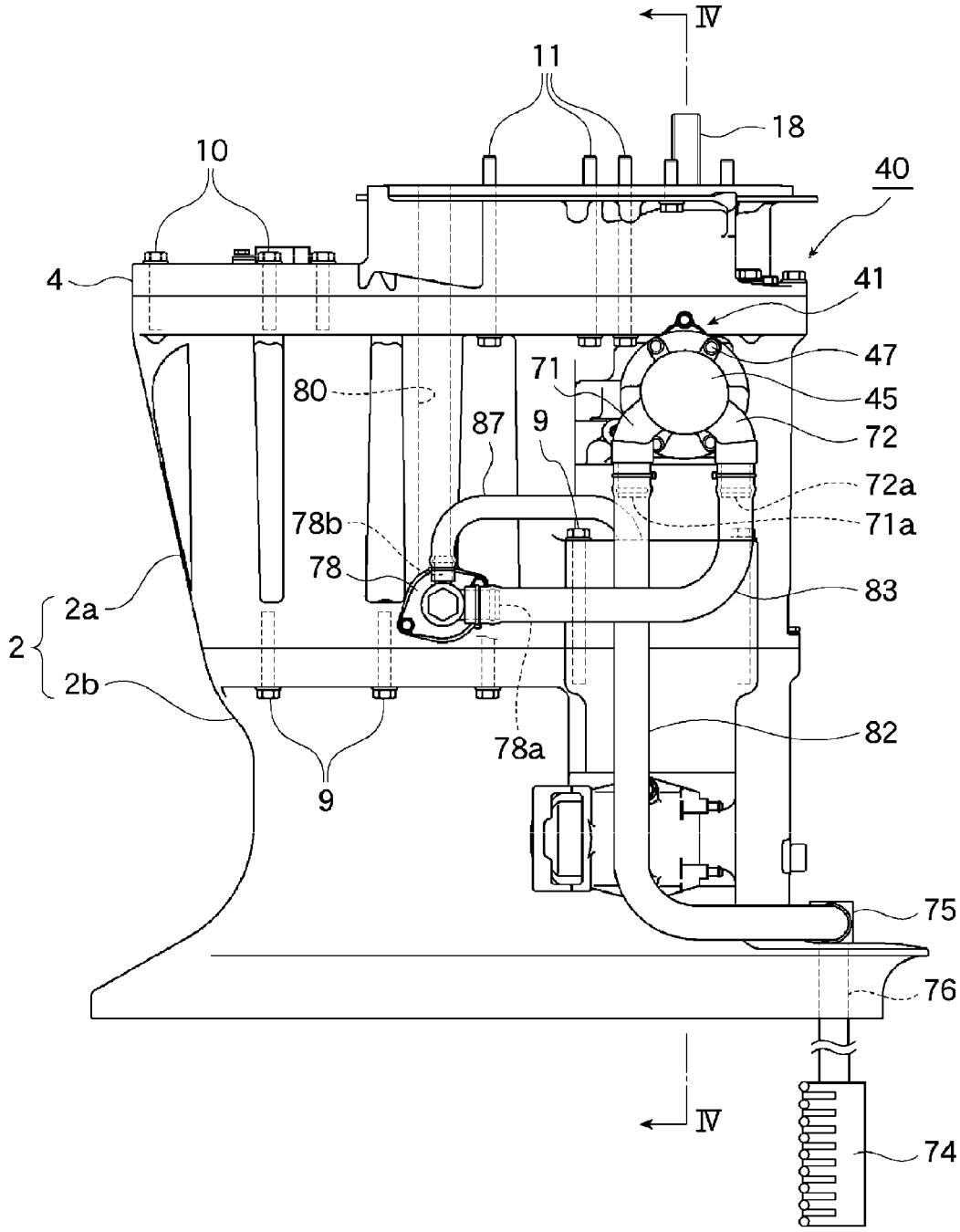
FIG. 3 is a right side view showing a general construction of a cooling system within section III of FIG. 1 in accordance with a preferred embodiment of the present invention on a larger scale.
Figure 4:
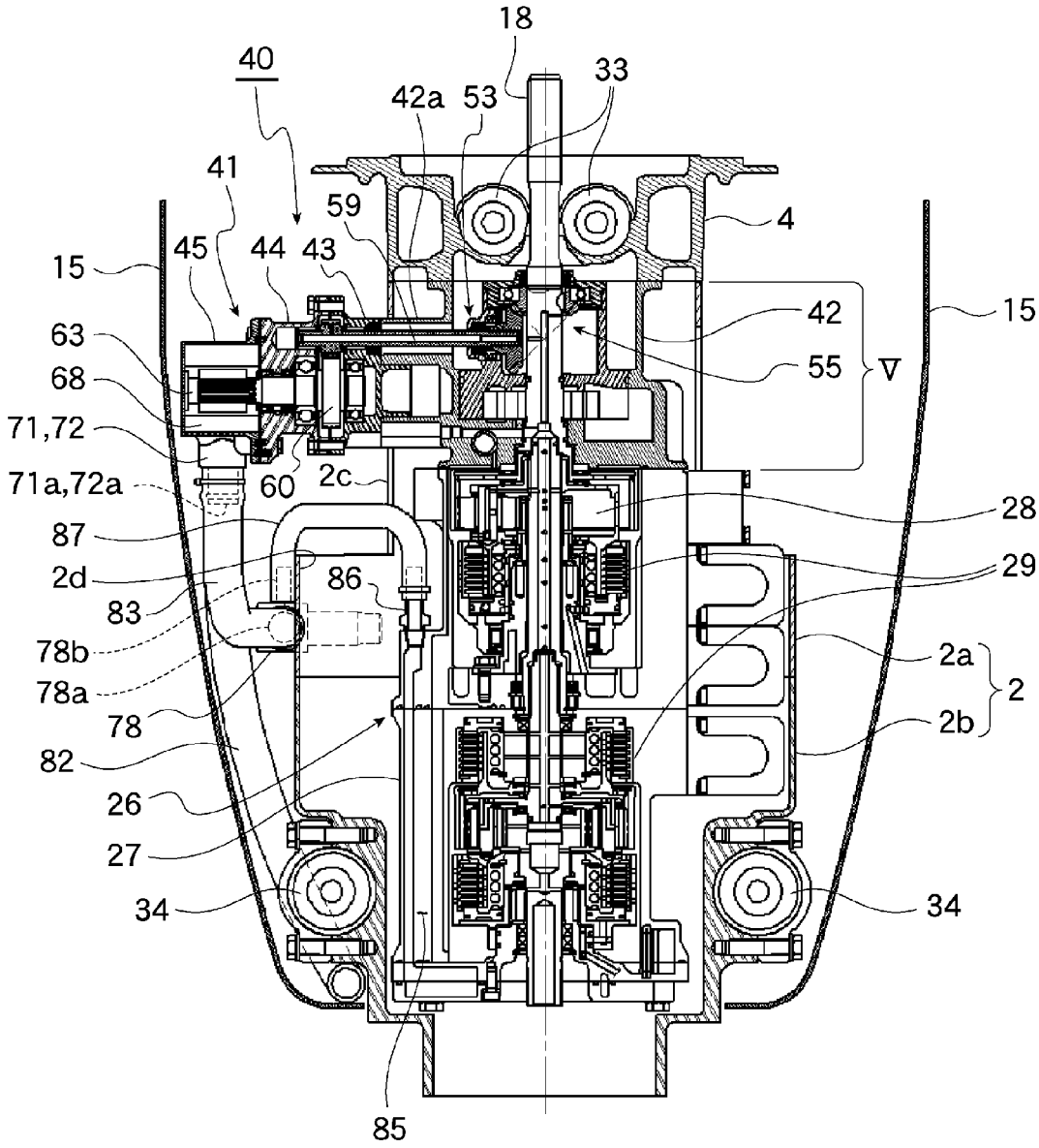
FIG. 4 is a vertical cross-sectional view taken along line IV-IV of FIG. 3 in accordance with a preferred embodiment of the present invention.

FIG. 1 is a right side view showing a preferred embodiment of an outboard motor in accordance with the present invention. FIG. 2 is a more detailed vertical cross-sectional view of FIG. 1. FIG. 3 is a right side view showing a general construction of the cooling system in accordance with a preferred embodiment of the present invention within section III of FIG. 1 on a larger scale. FIG. 4 is a vertical cross-sectional view taken along line IV-IV of FIG. 3.

An outboard motor 1 has a lower case 3 arranged below an upper case 2 and an engine 5 installed in an upper portion of the upper case 2 via a substantially flat mounting plate 4. The engine 5 preferably is, for example, a six-cylinder water-cooled engine having a V-type cylinder disposition, and is placed on the mounting plate 4 with its crankshaft 6 arranged in the vertical direction.

The upper case 2 is a block construction provided with an upper portion and a lower portion constructed such that an upper case section 2*a* and a lower case section 2*b* are fastened together preferably by a plurality of fixing bolts 9, for example. The mounting plate 4 is fixed to an upper surface of the upper case section 2*a* preferably by a plurality of fixing bolts 10 and through bolts 11, for example. The lower case 3 is fixed to a lower surface of the lower case section 2*b* preferably by fixing bolts (not shown). A casing 12 preferably includes the upper case 2 and the lower case 3. The through bolts 11 are inserted from a lower side of an upper flange of the upper case section 2*a*, pass through the mounting plate 4, and are tightened to the engine 5, thereby fastening the upper case section 2*a*, the mounting plate 4, and the engine 5 together.

The periphery of the engine 5 is covered by a removable upper cover 13 and a lower cover 14. Right and left side surfaces of the upper case 2 are covered by a removable side cover 15. FIG. 3 shows a state in which the side cover 15 is removed.

A drive shaft 18 is perpendicularly or substantially perpendicularly and pivotally supported in the casing 12. The drive shaft 18 is divided into a plurality of blocks in the axial direction. Its highest end is coupled to a lower end of the crankshaft 6 of the engine 5 by spline-fitting, for example. Its lowest end extends to the inside of the lower case 3 and is connected to a propeller shaft 20 horizontally and pivotally supported in the lower case 3 via a bevel gear mechanism 19. A transmission device 26, described below, is disposed in a middle portion of the drive shaft 18.

The propeller shaft 20 is preferably a double rotating shaft in which an outer shaft 20*a* and an inner shaft 20*b* are coaxially combined. A drive bevel gear 19*a* of the bevel gear mechanism 19 unitarily rotates with the drive shaft 18. A driven bevel gear 19*b* unitarily rotates with the outer shaft 20*a*. A driven bevel gear 19*c* unitarily rotates with the inner shaft 20*b*. A first propeller 21*a* is fixed to the outer shaft 20*a*. A second propeller 21*b* is fixed to the inner shaft 20*b*. These members define a counter-rotating propeller mechanism 22. An exhaust path 23 is provided in the axial portion of the first propeller 21*a* and the second propeller 21*b*.

The transmission device 26 is installed in the casing 12 (the upper case 2). The transmission device 26 is pivotally arranged around the drive shaft 18 and is constructed such that a torque converter 28 and an automatic transmission device 29 including a forward-reverse switching system are housed in a transmission case 27 defining the contour of the transmission device 26. An intermediate speed reducer 30 including a planetary gear mechanism is provided right below the transmission device 26 (see FIG. 1).

When the engine 5 starts, rotation of the crankshaft 6 is transmitted to the drive shaft 18. The speed of rotation of the drive shaft 18 is changed in the transmission device 26 and the rotational direction of the output may be switched into the forward or reverse direction. Further, the speed of rotation is reduced by the intermediate speed reducer 30 and the bevel gear mechanism 19, and transmitted to the propeller shaft 20. The outer shaft 20*a* and the first propeller 21*a*, and the inner shaft 20*b* and the second propeller 21*b* of the propeller shaft 20 rotate in directions opposite to each other, thereby generating a large propulsive force.

As shown in FIG. 4, a steering bracket (not shown) is coupled and fixed to a front portion of the outboard motor 1 via a pair of right and left upper mounts 33 installed inside the mounting plate 4 and a pair of right and left lower mounts 34 provided on right and left side surfaces of the lower case section 2*b* of the upper case 2. The steering bracket is coupled to a swivel bracket 36 by a perpendicular or substantially perpendicular steering shaft 35 shown in FIG. 1. The swivel bracket 36 is coupled to a clamp bracket 38 via a horizontal swivel shaft 37 and a locking mechanism (not shown). The clamp bracket 38 is fixed to a stern board (transom) of a watercraft.

The watercraft can be steered by turning the outboard motor 1 to the right or the left around the axis of the steering shaft 35. The outboard motor 1 can be tilted up above the water surface by turning it up or down around the axis of the swivel shaft 37.

The outboard motor 1 has a cooling system 40 arranged to draw in outside water and to supply the water to the engine 5 and the transmission device 26 as a coolant. The cooling system 40 includes a water pump 41 arranged to draw in outside water and a coolant distributing device arranged to distribute coolant discharged from the water pump 41 to the engine 5 and the transmission device 26.

The water pump 41 is preferably located on an outer surface of the upper case 2, for example, the right side surface in the traveling direction of the watercraft. The elevation of the water pump 41 is above the transmission device 26, and this position is sufficiently higher than the waterline WL (see FIG. 1) during operation of the outboard motor 1. FIG. 2 shows the water pump 41 in a displaced position from its normal location for more clearly understanding the construction of the water pump 41.

A separate pump mounting case 42 is preferably firmly fixed to an upper surface of the transmission case 27 of the transmission device 26, for example. An upper surface of the pump mounting case 42 is preferably firmly fixed to a lower surface of the mounting plate 4, for example.

Figure 5:
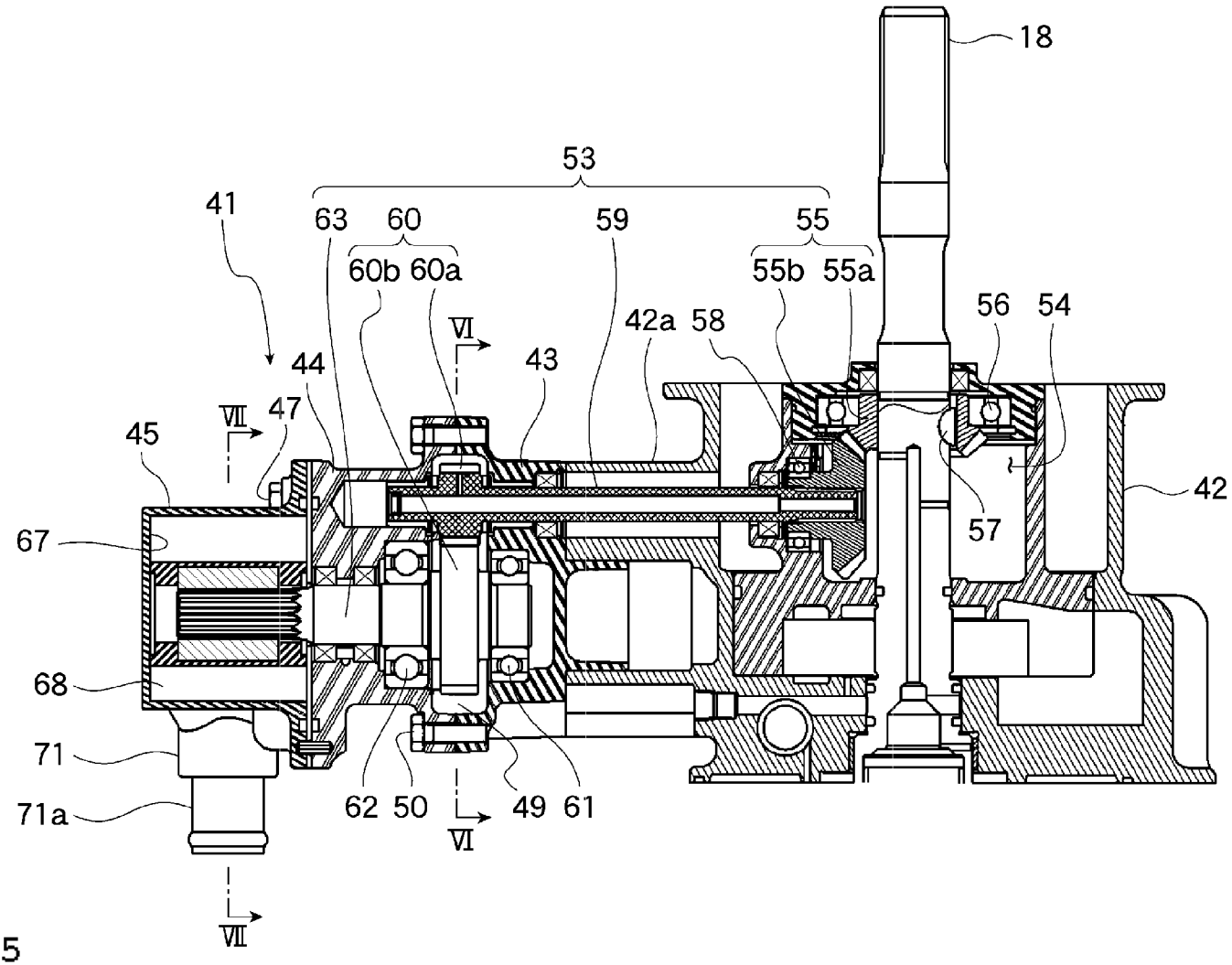
FIG. 5 is a vertical cross-sectional view showing section V of FIG. 4 in accordance with a preferred embodiment of the present invention on larger scale.

As shown in FIG. 5, an extension portion 42*a* extending horizontally is unitarily provided on a right side surface of the pump mounting case 42. Additionally, a pump opening 2*c* (see FIG. 4) is provided in a portion on a right side surface of the upper case section 2*a* defining the upper case 2, which is adjacent to the right side of the pump mounting case 42. The extension portion 42*a* of the pump mounting case 42 protrudes rightward to the outside from the pump opening 2*c*. The pump opening 2*c* is formed into a shape having pockets at different levels and also opens downward.

Figure 6:
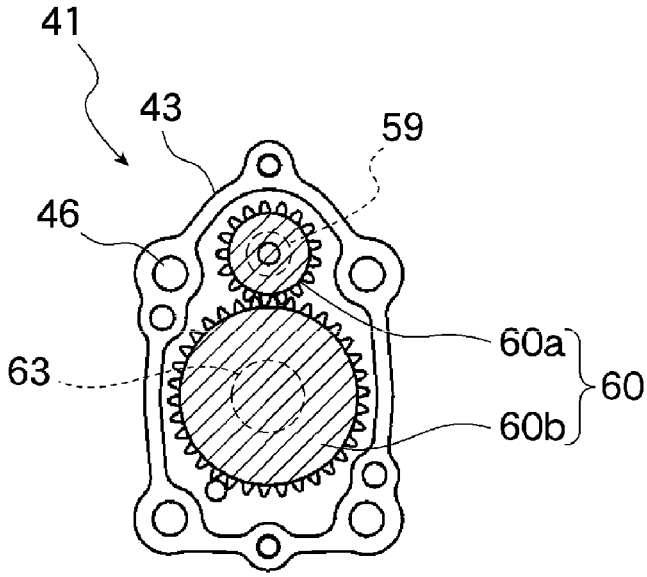
FIG. 6 is a vertical cross-sectional view taken along line VI-VI of FIG. 5 in accordance with a preferred embodiment of the present invention.

An inner gear housing 43, an outer gear housing 44, and a pump housing 45 are mounted on the extension portion 42*a* sequentially to the left one after another, as viewed in FIG. 5. These three members 43, 44, 45 and the extension portion 42*a* define a main section of the water pump 41. As shown in FIG. 6, pump fixing bolts 47 (see FIGS. 3 and 5) inserted from the outside into bolt holes 46 passing through the four corners of the three members 43, 44, and 45 are tightened to the extension portion 42*a*, thereby fastening the three members 43, 44, 45, and the extension portion 42*a* together.

As described above, all of the inner gear housing 43, the outer gear housing 44, and the pump housing 45 defining the main section of the water pump 41 protrude outside from the pump opening 2*c* in the upper case 2. Therefore, the three members 43, 44, and 45 are easily attached or detached only by inserting or removing the pump fixing bolts 47 from the outside.

A reducing gear chamber 49 is sealed and arranged to be liquid-tight between the inner gear housing 43 and the outer gear housing 44. The gear housings 43 and 44 are also fastened together preferably by two dedicated combining bolts 50 in addition to the pump fixing bolts 47, for example.

The speed of rotation of the drive shaft 18 is reduced by a pump driving mechanism 53, and the rotation is transmitted to the water pump 41 thereby driving the water pump 41. The pump driving mechanism 53 is constructed in the following manner.

A pump power take-off chamber 54 is provided in the pump mounting case 42. A bevel gear mechanism 55 is installed in the chamber. The bevel gear mechanism 55 includes a drive bevel gear 55*a* pivotally supported by a bearing 56 in the pump mounting case 42 and unitarily rotates with the drive shaft 18 via a woodruff key 57; and a driven bevel gear 55*b* pivotally supported by a bearing 58 and engaged with the drive bevel gear 55*a*. The gear ratio of the bevel gear mechanism 55 is preferably 1:1, for example.

A hollow pump drive shaft 59 arranged along the width direction of the outboard motor 1 extends through the extension portion 42*a* and the inside of the inner gear housings 43 and 44. A right end of the pump drive shaft 59, as seen in FIG. 5, is coupled to the driven gear 55*b* by spline-fitting, for example, to unitarily rotate therewith.

A reducing gear mechanism 60 is housed in the reducing gear chamber 49. The reducing gear mechanism 60 includes a reducing drive gear 60*a* and a reducing driven gear 60*b* engaged with the gear 60*a*. Both the gears 60*a* and 60*b* are, for example, helical gears, and the reduction ratio between them is approximately 1:1.5 to approximately 1:2, for example.

The reducing drive gear 60*a* is unitarily formed with the pump drive shaft 59 in a vicinity of a left end of the pump drive shaft 59, as viewed in FIG. 5. Additionally, an impeller shaft 63 is pivotally supported by a bearing 61 provided in the inner gear housing 43 and a bearing 62 provided in the outer gear housing 44. The reducing driven gear 60*b* is unitarily formed with the impeller shaft 63. The speed of rotation of the pump drive shaft 59 is reduced to approximately 1/1.5 to approximately ½, for example, by the reducing gear mechanism 60 and the rotation thereof is transmitted to the impeller shaft 63.

The pump driving mechanism 53 preferably includes the plurality of power transmission devices as described above, which include the bevel gear mechanism 55 and the reducing gear mechanism 60, the pump drive shaft 59, and the impeller shaft 63. The construction of the pump driving mechanism 53 is not limited to the above construction, but may include other types of driving devices.

Figure 7:
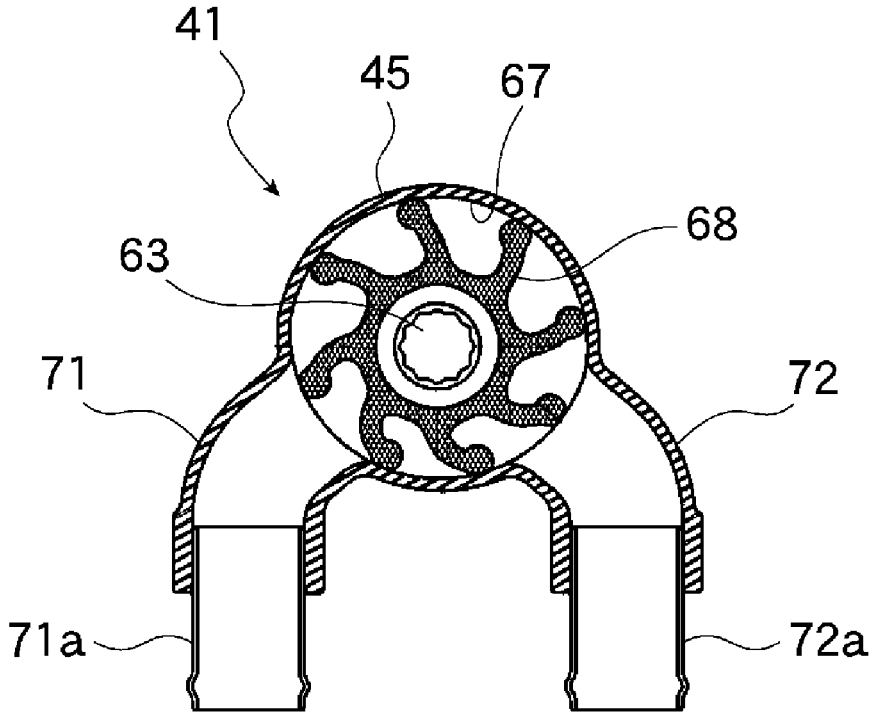
FIG. 7 is a vertical cross-sectional view taken along line VII-VII of FIG. 5 in accordance with a preferred embodiment of the present invention.

As shown in FIG. 7, a right end of the impeller shaft 63 eccentrically extends into an impeller chamber 67 defined in the pump housing 45. The impeller 68 is preferably provided on the right end of the impeller shaft 63 by spline-fitting, for example, on its free end so that the impeller 68 and the impeller shaft 63 unitarily rotate together. The impeller 68 is preferably made of an elastic material, such as rubber and urethane, into a shape of a water turbine having eight blades, for example. The impeller shaft 63 and the impeller 68 are eccentric to the central axis of the impeller chamber 67. In addition, side surfaces of the impeller 68 and tips of the blades contact with the right and left wall surfaces and a peripheral surface of the impeller chamber 67, thereby making the water pump 41 a vane-type pump.

A coolant inlet 71 and a coolant outlet 72 are provided on an outer periphery of the pump housing 45 housing the impeller 68. An inlet union 71*a* and an outlet union 72*a* are provided in the coolant inlet 71 and the coolant outlet 72, respectively. The coolant inlet 71 (the inlet union 71*a*) and the coolant outlet 72 (the outlet union 72*a*) together face the outside of the upper case 2 and are directed downward.

The coolant distributing device described above is constructed in the following manner, for example.

First, as shown in FIG. 1, a water intake 74 positioned below the waterline WL is provided on an outer surface of the lower case 3. A joint portion 75 exposed to the outside of the casing 12 in a position above the waterline WL is provided in a vicinity of an upper front end of the lower case 3 (see FIG. 3 also). A water intake path 76 extends upward from the water intake 74 and is connected to the joint portion 75 provided in the lower case 3.

As shown in FIGS. 2 through 4, a coolant relay section 78 having a three-way branch is provided outside the right side surface of the upper case 2 (the upper case section 2*a*). The coolant relay section 78 includes a wide outer conduit member connection 78*a* extending forward of the outboard motor and a narrow branch conduit member connection 78*b* extending upward. A coolant supply path 80 arranged to supply coolant toward the engine 5 is aligned in the vertical direction in the upper case section 2*a* and the mounting plate 4. The coolant relay section 78 is mounted to correspond to a position of a lower end of the coolant supply path 80 and is in communication with the coolant supply path 80.

The joint portion 75, which is an end section of the water intake path 76 in the lower case 3, and the coolant inlet 71 (the inlet union 71*a*) of the water pump 41 are connected together by an inlet conduit member 82. The coolant outlet 72 (the outlet union 72*a*) of the water pump 41 and the outer conduit member connection 78*a* of the coolant relay section 78 are connected together by an outlet conduit member 83. The inlet conduit member 82 and the outlet conduit member 83 are preferably both flexible hose members, and disposed outside the casing 12. The conduit members may be flexible hose members made of resin or may be flexible metallic conduits and the like.

As shown in FIGS. 2 and 4, a water jacket 85 is provided in the transmission case 27 of the transmission device 26. A coolant introduction union 86 in communication with a highest portion of the water jacket 85 is provided on a right side surface of the transmission case 27. The coolant introduction union 86 and the coolant relay section connection 78*b* of the coolant relay section 78 are connected together by a transmission cooling conduit member 87. A coolant discharge port (not shown) is provided in a lowest portion of the water jacket 85.

The transmission cooling conduit member 87 is preferably a flexible hose member and arranged to enter from the outside to the inside of the upper case 2 across an outer periphery 2*d* of the pump opening 2*c* formed into a shape having pockets at different levels.

The coolant distributing device includes the water intake 74, the water intake path 76, the coolant relay section 78, the inlet conduit member 82, the outlet conduit member 83, the transmission cooling conduit member 87, and so forth.

Bore diameters of the inlet union 71*a*, the outlet union 72*a*, the joint portion 75, and the outer conduit member connection 78*a* preferably have an equal size. The inlet conduit member 82 and the outlet conduit member 83 are preferably equal in width also. A bore diameter of the coolant relay section connection 78*b* is preferably smaller than the bore diameter of the outer conduit member connection 78*a*. The transmission cooling conduit member 87 is preferably narrower in width than the inlet conduit member 82 and the outlet conduit member 83. Each of the bore diameter sizes is determined corresponding to a ratio between the amount of coolant delivered to the water jacket of the engine 5 and the amount of coolant delivered to the water jacket 85 of the transmission device 26 so as to ensure the most effective coolant flow and distribution.

The inlet conduit member 82, the outlet conduit member 83, and the transmission cooling conduit member 87 are covered by the side cover 15 together with the water pump 41 and the pump opening 2*c*. Therefore, these members 82, 83, 87, 41, and 2*c* are not exposed in the external appearance of the outboard motor 1.

The cooling system 40 is preferably constructed in the foregoing manner. When the engine 5 of the outboard motor 1 starts, rotation of the drive shaft 18 is transmitted to the pump drive shaft 59 at a constant speed by the bevel gear mechanism 55 whose gear ratio is 1:1. Thereafter, the speed of rotation of the pump drive shaft 59 is reduced to approximately 1/1.5 to approximately ½ by the reducing gear mechanism 60 whose gear ratio is approximately 1:1.5 to approximately 1:2 and the rotation is transmitted to the impeller shaft 63 and the impeller 68. The impeller 68 rotates clockwise in FIG. 7.

When the impeller 68 rotates in the impeller chamber 67 of the pump housing 45, outside water is drawn through the water intake 74 due to negative pressure generated in the coolant inlet 71. The water flows in the order of the water intake 74→the water intake path 76→the joint portion 75→the inlet conduit member 82→the water pump 41→the outlet conduit member 83→the coolant relay section 78→the coolant supply path 80, and supplied to the water jacket (not shown) in the engine 5 as coolant thereby cooling the engine 5.

Coolant that has cooled the engine 5 passes through an exhaust expansion chamber (not shown) in the upper case 2 and the lower case 3 and the exhaust path 23 in the axial portion of the first propeller 21*a* and the second propeller 21*b*, and is discharged into the outside water together with exhaust gas of the engine 5.

A portion of the coolant branches off toward the coolant relay section connection 78*b* in the coolant relay section 78, passes through the transmission cooling conduit member 87 and the coolant introduction union 86, and supplied to the highest portion of the water jacket 85 thereby cooling the transmission device 26.

Coolant that has cooled the transmission device 26 is discharged to the exhaust expansion chamber through the coolant discharge port (not shown) provided in the lowest portion of the water jacket 85, and is discharged into the outside water together with coolant that has cooled the engine 5 and exhaust gas via the exhaust path 23.

In the cooling system 40, coolant discharged from the single water pump 41 is distributed and supplied to the engine 5 and the transmission device 26 (the water jacket 85) by the coolant distributing device including the coolant relay section 78, the inlet conduit member 82, the outlet conduit member 83, and the transmission cooling conduit member 87. Therefore, it is not required to construct a cooling system including a dedicated water pump for cooling the transmission device 26. The transmission device 26, which is the second most heat generating portion next to the engine 5, can be effectively cooled with a very simple construction. Further, cooling efficiency is high since the transmission device 26 is not cooled by warmed coolant coming from the engine 5 as in automobiles.

The cooling system 40 has such a construction that coolant is supplied from the highest portion of the water jacket 85 of the transmission device 26 and discharged from the lowest portion. Accordingly, coolant in the water jacket 85 is actively replaced with the flow caused by natural convection in which coolant at a higher temperature floats and coolant at a lower temperature sinks in the water jacket 85. Thereby, the transmission device 26 can be effectively cooled from its highest portion to lowest portion. Further, the cooling system 40 facilitates the discharge of water from the water jacket 85 after the engine 5 is stopped, thereby preventing problems such as corrosion and freezing.

Further, the cooling system 40 in accordance with the present preferred embodiment has all the structural elements such as the coolant inlet 71 and the coolant outlet 72 of the water pump 41, the joint portion 75 which is the end section of the water intake path 76 extending from the water intake 74, the coolant relay section 78, the inlet conduit member 82, the outlet conduit member 83, and the transmission cooling conduit member 87, disposed outside the casing 12. This highly facilitates connection between these structural members. Accordingly, the transmission device 26 can be effectively cooled with a construction facilitating assembly and maintenance.

In the cooling system 40 in accordance with the present preferred embodiment, the bore diameters of the inlet conduit member 82 and the outlet conduit member 83 are different from the bore diameter of the transmission cooling conduit member 87. Therefore, the bore diameter of the transmission cooling conduit 87 is set to an arbitrary size corresponding to the bore diameters of the other conduit members 82 and 83, thereby setting the amount of coolant distributed to the transmission device 26 to an optimal amount. Accordingly, the transmission device 26 can be effectively cooled with a simple construction.

As described above, coolant is distributed to the engine 5 and the transmission device 26 at the coolant relay section 78, thereby allowing providing a transmission cooling system separate from the cooling system for the engine 5. Accordingly, influences from the other cooling system can be prevented, and a high efficiency in the cooling performance can be obtained. The preferred embodiments of the present invention are not limited to the transmission device 26 described above. As a modification, the system may be constructed to distribute coolant to other structural elements of the outboard motor such as structural elements that generate heat. The system may be constructed such that a plurality of branch conduit member connections 78*b* are provided and coolant is simultaneously distributed to a plurality of heat generating portions of the engine 5 or a plurality of heat generating portions other than the engine 5.

The inlet conduit member 82, the outlet conduit member 83, and the transmission cooling conduit member 87 are preferably provided with flexible hose members. Therefore, the arrangement of these conduits 82, 83, and 87 can be improved. This facilitates the connections between the conduits, thus improving the assembly of the outboard motor 1.

The water pump 41 preferably is thoroughly exposed to the outside of the casing 12 in the present preferred embodiment. However, it is not necessarily required that the water pump 41 itself be located outside the casing 12. For example, the system may be constructed such that the water pump 41 is provided inside the casing 12, wherein only the coolant inlet 71 and the coolant outlet 72 open to the outside of the casing 12, and the inlet conduit member 82 and the outlet conduit member 83 are located outside the casing 12.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A cooling system for an outboard motor including an engine installed in an upper portion of a casing, a transmission device installed inside the casing, and a water pump arranged to pump coolant for cooling the engine, the cooling system comprising:

a coolant distributing device arranged to distribute coolant discharged from the water pump; wherein the coolant distributing device includes:

a coolant relay section arranged to distribute the coolant to both the engine and the transmission device; and a transmission cooling conduit member branched from the coolant relay section to supply a portion of the coolant to the transmission device.

2. The cooling system for the outboard motor according to claim 1, wherein the coolant distributing device is arranged to supply the portion of the coolant discharged from the water pump to a highest portion of a water jacket of the transmission device and discharge the coolant from a lowest portion of the water jacket.

3. The cooling system for the outboard motor according to claim 1, wherein the water pump is arranged such that at least a coolant inlet and a coolant outlet thereof face an outside of the casing, and the coolant distributing device includes:

the coolant relay section located outside the casing and in communication with an engine coolant supply path in the casing;

an inlet conduit member located outside the casing and having an upstream end connected to a water intake provided below the casing and a downstream end connected to the coolant inlet;

an outlet conduit member located outside the casing and arranged to connect the coolant outlet and the coolant relay section; and the transmission cooling conduit member having a first end connected to the coolant relay section and a second end connected to a highest portion of a cooling portion of the transmission device.

4. The cooling system for the outboard motor according to claim 3, wherein bore diameters of the inlet conduit member and the outlet conduit member are different from a bore diameter of the coolant relay section.

5. The cooling system for the outboard motor according to claim 3, wherein at least one of the inlet conduit member, the outlet conduit member, and the transmission cooling conduit member includes a flexible hose member.

* * * * *